United States Patent [19]

Müller et al.

[11] Patent Number: 4,655,473

[45] Date of Patent: Apr. 7, 1987

[54] PROCESS OF MANUFACTURING A SKI

[75] Inventor: Alfred Müller, Lucerne, Switzerland
Johann Kohler-Pavlek, Vienna, Austria

[73] Assignee: Realverbund, Zug, Switzerland

[21] Appl. No.: 867,622

[22] Filed: May 27, 1986

Related U.S. Application Data

[63] Continuation of Ser. No. 677,908, Dec. 6, 1984, abandoned, which is a continuation of Ser. No. 501,419, Jun. 6, 1983, abandoned.

[30] Foreign Application Priority Data

Jun. 7, 1982 [AT] Austria ..... 2193/82

[51] Int. Cl.[4] ..... B29C 45/00; B29C 47/00; B29D 9/00; A63C 5/00

[52] U.S. Cl. ..... 280/610; 264/101; 264/128; 264/261; 264/DIG. 78; 425/110; 425/DIG. 59; 425/DIG. 60

[58] Field of Search ..... 264/101, 128, 261, DIG. 78; 425/110, DIG. 59, DIG. 60; 280/610

[56] References Cited

U.S. PATENT DOCUMENTS

| | | | |
|---|---|---|---|
| 3,026,575 | 3/1962 | Lusher et al. | 425/110 |
| 3,192,594 | 7/1965 | Fougea | 25/121 |
| 3,498,626 | 3/1970 | Sullivan | 280/11.13 |
| 3,816,573 | 6/1974 | Hashimoto et al. | 264/46.5 |
| 3,875,278 | 4/1975 | Brandt | 264/90 |
| 3,958,810 | 5/1976 | Böhm | 264/46.5 X |
| 3,975,479 | 8/1976 | McClean | 264/102 |
| 4,030,953 | 6/1977 | Rutschow et al. | 264/45.3 |
| 4,044,083 | 8/1977 | Howe et al. | 264/261 |
| 4,201,823 | 5/1980 | Russell | 264/101 |
| 4,259,274 | 3/1981 | Tiitola | 264/101 |

FOREIGN PATENT DOCUMENTS

| | | |
|---|---|---|
| 1145905 | 5/1983 | Canada . |
| 2127330 | 12/1972 | Fed. Rep. of Germany . |
| 2940851 | 4/1980 | Fed. Rep. of Germany . |

OTHER PUBLICATIONS

*Ski* Magazine Buyer's Guide 1985, p. 46.
*Skiing* Magazine, vol. 38, No. 3, Nov. 1985, pp. 234 and 142.

*Primary Examiner*—Nancy Swisher
*Attorney, Agent, or Firm*—Fleit, Jacobson, Cohn & Price

[57] ABSTRACT

A process of manufacturing a composite ski, particularly a laminated ski. The constituent parts of the ski are placed into an evacuable mold, which during or after its evacuation is supplied with a binder, which is preferably liquid and fills the pores of the constituent parts and the cavities between the constituent parts.

26 Claims, 4 Drawing Figures

Fig. 1
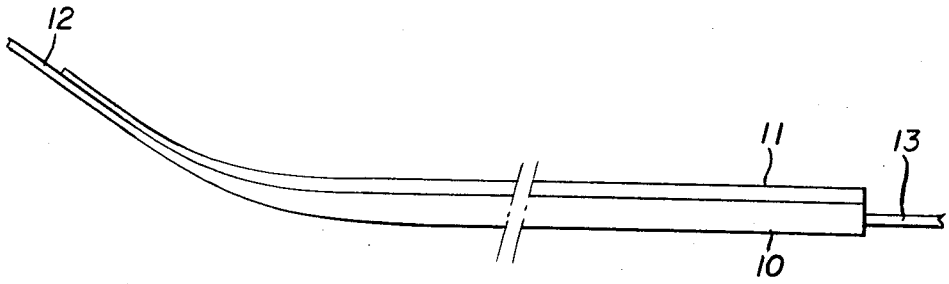
Fig. 2
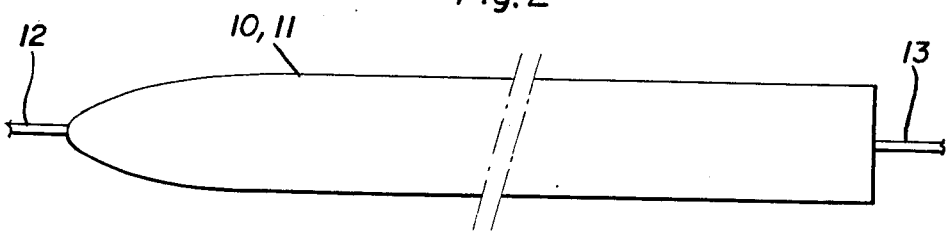
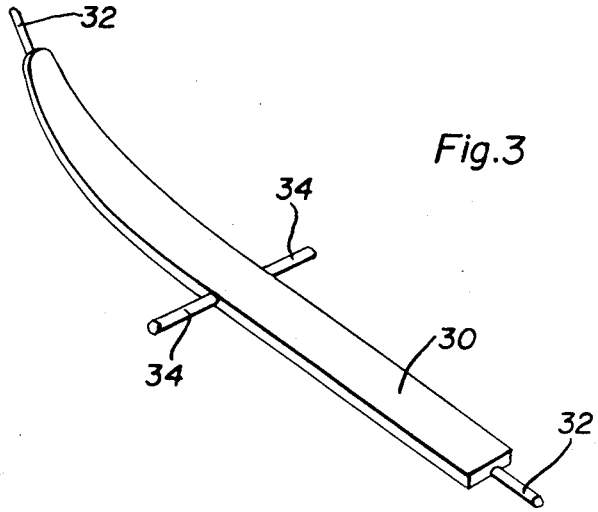
Fig. 3
Fig. 4
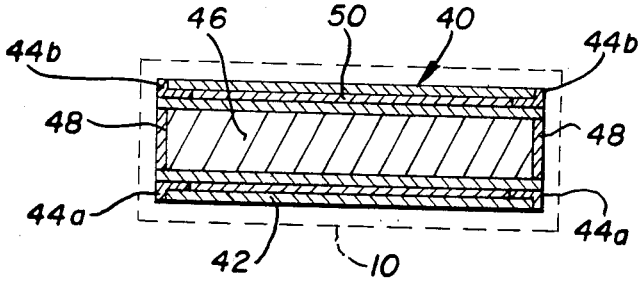

PROCESS OF MANUFACTURING A SKI

This application is a continuation of application Ser. No. 677,908, filed Dec. 6, 1984, now abandoned, which is a continuation of application Ser. No. 501,419 filed June 6, 1983, now abandoned.

SUMMARY OF THE INVENTION

It is an object of the invention to provide a process of manufacturing a composite ski. The constituent parts of the ski are placed into a mold, which is subsequently evacuated and supplied with a binder.

This invention relates to a process of manufacturing a composite ski, particularly a laminated ski.

Many skis consist of sandwich structures. Numerous skis of that type are known; their layers are joined with the aid of adhesives under the action of heat and pressure. Whereas that process of joining the constituent parts of the ski is simple, problems have arisen owing to the application of pressure, which has adversely affected the appearance of the ski and the integrity of its constituent parts. This fact has required the use of constituent parts of high compressive strength.

U.S. Pat. No. Specification 3,498,626 describes a metal ski which has an internal cavity filled with foamed plastic material. By means of pumps, the plastic material in a liquid state is forced into a interior of the ski through a hole disposed near the center of the length of the ski, and the latter is provided at its ends with holes, which are connected by lines to a vacuum pump so that air and reaction gases are sucked from the ski and the flow of the liquid plastic material along the ski is promoted.

A plastic ski having a foamed core is described in U.S. Pat. No. 4,259,274 and in Laid-open German Application No. 29 40 851. That ski is made in a mold, which is formed in its top inside surface with ports, which are connected to a vacuum pump and serve to hold facing parts or the like in position. In the manufacture of a plastic ski which has a foamed core, the same technology is used in a process disclosed in Laid-open German Application No. 21 27 330 and using a twin injection molding machine.

It is apparent that in the manufacture of metal skis the use of a vacuum is known only for sucking enclosed air and reaction gases and for promoting the flow of the liquid plastic material during the injection. In the manufacture of plastic skis in molds, it is known to use a vacuum only for holding facing parts or the like in position.

It is also known to provide a ski which comprises a skeleton which surrounds and is embedded in a plastic material composition to form a ski body. That plastic material composition may be foamed. In accordance with Laid-open German Application No. 20 14 025 that skeleton comprises side walls and a web, which connects said side walls and extends throughout the width of the ski and may be formed with apertures and is disposed at the bottom or on an intermediate level. Those skis have the disadvantage that the manufacture of the skeleton is expensive.

Laid-open German Application No. 20 54 952 discloses a laminated ski, which comprises a core of foamed plastic material and top and bottom facings. The core comprises longitudinally spaced apart, profiled reinforcing members, which are H-shaped in cross-section and have apertured walls. The flanges of said profiled members are parallel to the side faces of the ski and the web is parallel to the tread of the ski and disposed on an intermediate level of the ski. The performance of said skis is not satisfactory and just as with the ski of the design described last hereinbefore it is difficult to apply the steel edges.

It is an object of the invention to provide measures by which all these problems can be solved in a simple manner. In a process of the kind described first hereinbefore this object is accomplished in accordance with the invention in that the constitutent parts of the ski are placed into a mold, the mold is evacuated and a binder is supplied to the mold during or after its evacuation.

FIG. 1 is a perspective view of a mold for manufacturing a composite ski in accordance with the present invention, the mold having vacuum and binder ports on respective opposite side edges of the mold.

FIG. 2 is a perspective view similar to FIG. 1 wherein the vacuum ports are provided on the opposed side edges of the mold and the binder ports are provided at the ends of the mold corresponding with the ends of the ski.

FIG. 3 is a perspective view of a mold similar to FIG. 2, in which vacuum is applied to the ends of the mold corresponding with the ends of the ski, and binder is supplied at the center of the length of the ski.

FIG. 4 is a cross-sectional view of a mold showing the constituent parts for one type of ski structure that can be made in accordance with the present invention.

The binder may consist, e.g., of a liquid resin. That process is suitable for quantity production and can be carried out with apparatus which can be operated in an extremely simple manner.

The mold which contains the constituent parts of the ski is preferably pre-evacuated before the binder is supplied to the mold. In that case the vacuum present in the mold before the supply of the binder will result in a removal of air from all pores of the constituent parts of the ski which have been placed into the mold so that the binder will enter the pre-evacuated mold as by a shot and will fill all pores when a valve in the binder supply line has been opened. As the pores are defined by surfaces having microscopic fissures so that the pores cannot be completely filled with liquid resin in the known process and air-filled dead spaces are then left in the pores, it will be understood that in that case the polymerized resin will not be properly bonded to the surfaces defining said pores and the resulting bonds will not resist the extreme stresses to which the constituent parts of the ski are subjected in use. On the other hand, the pre-evacuation results in a removal of virtually all air from the pores so that the latter will be virtually completely filled by the binder. As a result, the cured binder will be adequately bonded to the surfaces of the pores and the resulting bonds will resist even extremely high stresses.

It has proved particularly desirable to provide the molds with ports which face the side edges of the ski and are longitudinally spaced apart and to use said ports to suck air from the mold and to supply binder to the mold. In a particularly desirable embodiment, as shown in FIG. 1, air is sucked from the mold 10 on one side 12 of the ski through ports 14 and binder is supplied to the mold 10 on the other side 16 of the ski through ports 18.

In a preferred embodiment as shown in FIG. 2, air may be sucked from the mold 20 through ports 22 near the center of the length of the ski and binder may be supplied near both ends of the ski through ports 24, or as shown in FIG. 3 air may be sucked from the mold 30 at the ends of the ski through ports 32 and binder may be supplied to the mold 30 at the center of the length of the ski through ports 34.

The binder may be supplied to the mold under pressure or may be sucked into the mold under a progressively increasing vacuum. In accordance with a feature of the invention, binder may be supplied to the mold until the binder emerges through the suction opening of the mold. If it is desired to subsequently establish a super-atmospheric pressure in the mold, it will be recommendable to close a valve provided in the suction line and to supply additional binder to the mold under pressure.

The binder may be cured under the action of heat, particularly if the binder consists of a liquid resin.

It is desirable to use in the process according to the invention a mold which is directly evacuable. This means that the suction line or lines is or are directly connected to the mold. Similar remarks are applicable to the line or lines for supplying the binder. The component parts of the ski 40, as shown in FIG. 4, can include the tread layer 42, the steel edges 44*a*, a lower flange (not shown), a core laminate 46 and/or other constituent parts, side walls 48, also an upper top flange (not shown), a top facing 50 and upper side edges 44*b* are consecutively placed into said mold 10 in known manner. It will be understood that the selection of the constituent parts and their shape and nature as well as their arrangement will be left to the discretion of the designer because these measures are no part of the invention. Preforms may also be used within the scope of the invention. The use of glass fibers and the nature of the latter is permissible within the scope of the invention but is no part thereof. For instance, individual fibers, rovings, laminates, woven fabrics, mats and the like may be used individually or in combination. The remaining parts of the ski may be made of any desired suitable material, such as wood, plastic material, metal, e.g., aluminum, steel, or the like.

Any glass fibers will be placed into the mold when the glass fibers are in a dry state. As a result, the impregnation of the glass fibers outside the mold with liquid resin required in the previous process can be omitted. These operations were inconvenient and owing to the formation of toxic gases and vapors were sometimes deleterious to the health of the workers.

The binder may consist of a liquid resin, e.g., a liquid polyester resin or epoxy resin. Any other binder may be used, preferably one which can be cured under the action of heat. For instance, a foamable composition may be used for that purpose.

It will be understood that various other measures may be adopted within the scope of the invention. For instance, the resin may be vacuum-treated before it is admitted to the mold.

What is claimed is:

1. A process of manufacturing a laminated composite ski in an enclosed mold, comprising the steps of:

(a) placing into an elongated ski-shaped forming mold a plurality of ski forming components, comprising the tread layer, steel edges, core laminate parts, side walls and top facing layers, said components and said mold defining a major longitudinal axis and a plurality of minor transverse axes perpendicular to the longitudinal axes, and positioned at a plurality of locations along the longitudinal axes including at the ends thereof, these transverse and longitudinal axes defining a series of sideport locations comprising vacuum openings or binder supply openings;

(b) evacuating the mold by providing communication between the mold and a source of vacuum to remove air and any other gases present from the mold through one or more of the vacuum openings located at one or more of the sideport locations at least one of which being defined by the transverse axes;

(c) introducing a binder into the mold through one or more of the sideport locations (d) introducing a binder into the mold through one or more binder openings in the mold, at least one of the vacuum or binder openings being defined by at least one of the transverse axes, said binder being introduced while maintaining communication with the vacuum source at the same time until the binder completely fills the spaces between each of the component parts of the ski;

(e) curing the binder within the mold;

(f) removing the final ski structure from the mold.

2. The process according to claim 1 wherein the liquid binder is supplied to the mold until it emerges from the vacuum openings.

3. The process according to claim 1 wherein the binder is supplied at the same time that the air and other gases are being evacuated from the mold.

4. The process according to claim 1 wherein the binder is supplied after the mold has been pre-evacuated before introduction of the binder.

5. The process according to claim 1 wherein the vacuum openings are on one end of one or more transverse axes and the binder openings are on the opposite ends thereof.

6. The process according to claim 1 wherein the vacuum openings are along a transverse axis and the binder openings are located at the ends of the longitudinal axis.

7. The process according to claim 1 wherein the vacuum openings are located at the ends of the longitudinal axis and the binder openings are located along at least one transverse axis.

8. The process according to claim 1 wherein the vacuum openings are located on one set of transverse axes at the end thereof and the binder openings are on another set of transverse axes on the ends of the axes opposite that of the vacuum openings.

9. The process according to claim 1 wherein one set of the axes is located near but not at the end of the longitudinal axis.

10. The process according to claim 1 wherein the components further comprise a lower flange member, an upper top flange, upper side edge members or any combination thereof.

11. The process according to claim 1 wherein the liquid binder is a polyester resin.

12. The process according to claim 1 wherein the liquid binder is an epoxy resin.

13. The process according to claim 1 wherein the curing step is effected with use of heat supplied to the mold.

14. The ski made by the process of claim 1.

15. The ski made by the process of claim 2.

16. The ski made by the process of claim 3.

17. The ski made by the process of claim 4.

18. The ski made by the process of claim 5.

19. The ski made by the process of claim 6.

20. The ski made by the process of claim 7.
21. The ski made by the process of claim 8.
22. The ski made by the process of claim 9.
23. The ski made by the process of claim 10.
24. The ski made by the process of claim 11.
25. The ski made by the process of claim 12.
26. The ski made by the process of claim 13.

* * * * *